US010051901B2

(12) United States Patent
Peyser

(10) Patent No.: US 10,051,901 B2
(45) Date of Patent: Aug. 21, 2018

(54) JACKET CONVERTIBLE TO A NECK PILLOW

(71) Applicant: DPI IMPORTS, INC., Bay Shore, NY (US)

(72) Inventor: Eliot Peyser, Bay Shore, NY (US)

(73) Assignee: DPI IMPORTS, INC., Bay Shore, NY (US)

( * ) Notice: Subject to any disclaimer, the term of this patent is extended or adjusted under 35 U.S.C. 154(b) by 66 days.

(21) Appl. No.: 15/329,833

(22) PCT Filed: Jul. 8, 2016

(86) PCT No.: PCT/US2016/041491

§ 371 (c)(1),
(2) Date: Jan. 27, 2017

(87) PCT Pub. No.: WO2017/008005

PCT Pub. Date: Jan. 12, 2017

(65) Prior Publication Data

US 2017/0258154 A1 Sep. 14, 2017

Related U.S. Application Data

(60) Provisional application No. 62/189,968, filed on Jul. 8, 2015.

(51) Int. Cl.
*A45F 3/00* (2006.01)
*A41D 15/04* (2006.01)
(Continued)

(52) U.S. Cl.
CPC ..... *A41D 15/04* (2013.01); *A41D 3/00* (2013.01); *A41D 27/18* (2013.01); *A41D 27/201* (2013.01);
(Continued)

(58) Field of Classification Search
CPC ..... A45F 3/04; A45F 3/00; A45C 9/00; A47G 9/10
See application file for complete search history.

(56) References Cited

U.S. PATENT DOCUMENTS 5,850,634 A * 12/1998 Toombs ..... A41D 15/04 2/93
7,657,954 B1 * 2/2010 Bunkers ..... A42B 1/048 2/202
(Continued)

FOREIGN PATENT DOCUMENTS

| | | | |
|---|---|---|---|
| CN | 202932098 | U | 5/2013 |
| EP | 2048980 | B1 | 1/2010 |
| KR | 10-2012-0006783 | A | 1/2012 |

OTHER PUBLICATIONS

International Search Report and Written Opinion dated Oct. 26, 2016, from the corresponding PCT/US2016/041491.
(Continued)

*Primary Examiner* — Tejash Patel
(74) *Attorney, Agent, or Firm* — Katten Muchin Rosenman LLP

(57) ABSTRACT

Disclosed herein is a jacket which is convertible into a neck pillow, and vice versa. The jacket comprises a pouch concealed within a cavity of the collar of the jacket by a zipper. The pouch is deployed by unzipping the zipper and removing the pouch from the cavity. A portion of the pouch is connected to the inside of the cavity by any suitable retaining means such as stitching or adhesive. The pouch is in the shape of a standard neck pillow, though other designs, such as a rectangular pillow are also possible.

8 Claims, 12 Drawing Sheets

(51) Int. Cl.

| | |
|---|---|
| ***A47G 9/10*** | (2006.01) |
| ***A41D 27/18*** | (2006.01) |
| ***A41D 3/00*** | (2006.01) |
| ***A41D 27/20*** | (2006.01) |

(52) U.S. Cl.
CPC ..... *A45F 3/00* (2013.01); *A47G 9/10* (2013.01); *A47G 9/1045* (2013.01); *A41D 2300/322* (2013.01); *A41D 2400/422* (2013.01)

(56) References Cited

U.S. PATENT DOCUMENTS

| | | | | |
|---|---|---|---|---|
| 8,424,114 | B2 * | 4/2013 | Snyder | A47C 16/00 2/86 |
| 2009/0241235 | A1 * | 10/2009 | Weinreb | A41D 15/04 2/84 |
| 2011/0088135 | A1 | 4/2011 | Snyder et al. | |
| 2013/0152270 | A1 * | 6/2013 | Neal | A41D 3/005 2/84 |
| 2013/0219624 | A1 * | 8/2013 | Soffer | A45F 4/02 5/636 |
| 2015/0121604 | A1 | 5/2015 | Lee et al. | |
| 2017/0224033 | A1 * | 8/2017 | Latta, Jr. | A41D 15/04 |

OTHER PUBLICATIONS

International Preliminary Report on Patentability dated Jan. 9, 2018, from the corresponding PCT/US2016/041491.

* cited by examiner

JACKET CONVERTIBLE TO A NECK PILLOW

FIELD OF THE INVENTION

The present invention is directed to a jacket that can be converted into a neck pillow.

BACKGROUND

Travel, by any means, can often be an uncomfortable affair for a number of reasons. In particular, airline travel has become increasingly uncomfortable in recent years as the width of seats has shrunk and legroom has been reduced. Also, items once considered complimentary, such as blankets and head pillows, are no longer offered on many airlines. As a result, many travelers now carry a neck pillow with them during travel. These neck pillows take up extra storage space in luggage that could be used for additional travel items or they must be carried by the traveler externally, adding to the traveler's inconvenience. In view of these limitations, there exists a need for a neck pillow that can be transported easily and can serve more than a singular purpose. The present invention has been to provide such a product.

SUMMARY

The present invention provides a jacket which is convertible into a neck pillow, and vice versa. The jacket comprises a pouch concealed within a cavity the collar of the jacket by a zipper. The pouch is deployed by unzipping the zipper and removing the pouch from the cavity A portion of the pouch is connected to the inside of the cavity by any suitable retaining means such as stitching or adhesive. The pouch is in the shape of a standard neck pillow, though other designs, such as a rectangular pillow are also possible.

The pouch has its own zipper which much be undone before conversion of the jacket into a neck pillow. Before stuffing the jacket into the pouch to form the neck pillow, it is preferable that the arms of the jacket are first placed into the corresponding arms of the neck pillow to form the stuffing for the arms of the neck pillow. Next, it is preferable that the body of the jacket is rolled up and then stuffed into the pouch. The body of the jacket forms the stuffing for the body of the neck pillow.

After the arms and body of the jacket have been placed into the pouch, the zipper of the pouch is closed, thereby completing transformation of the jacket into a neck pillow. The neck pillow may comprise a closure for connecting the two arms of the neck pillow together. The closure can be used to secure the neck pillow around a traveler's neck or to attach the neck pillow to an item when it is not in use.

DETAILED DESCRIPTION

Figure 1:
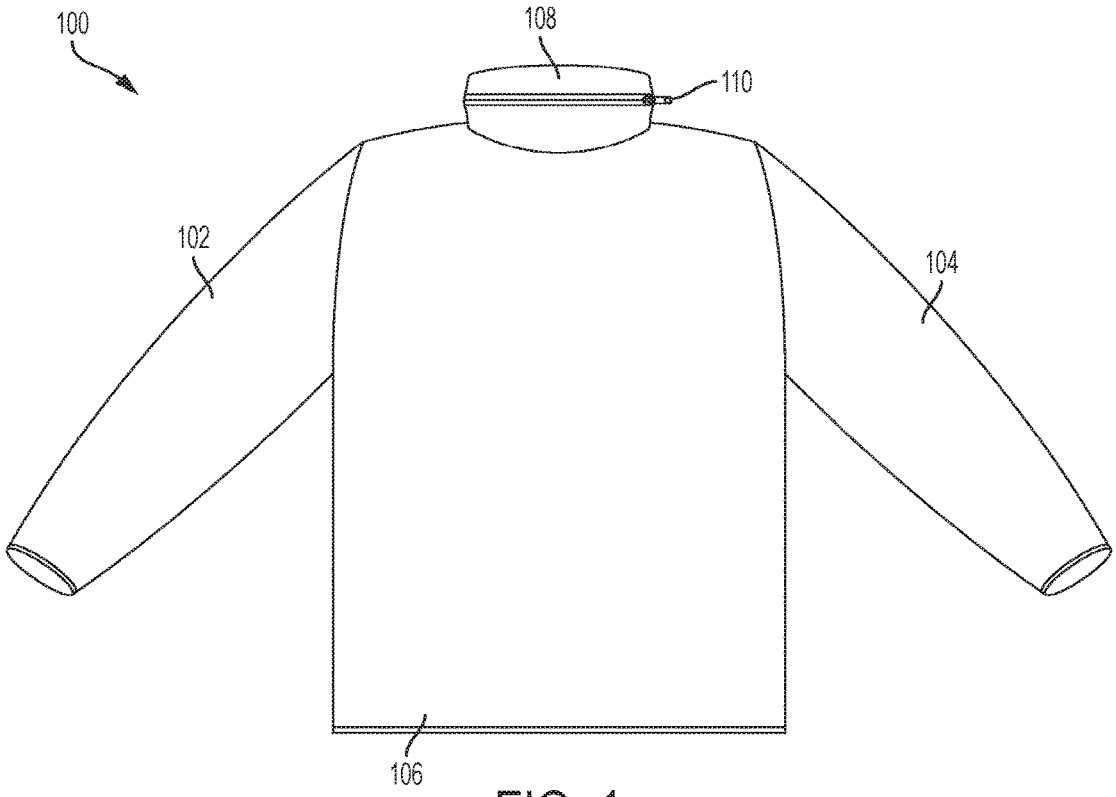
FIG. 1 is a rear view of the jacket.

FIG. 1 depicts a rear view of convertible jacket 100. As shown, convertible jacket 100 generally comprises left arm 102, right arm 104, body 106, and collar 108. Convertible jacket 100 can be any type of jacket including, but not limited to, a down jacket, an insulated synthetic jacket, a blazer, or a spring jacket. Preferably, the exterior of convertible jacket 100 is constructed from a durable, wrinkle-resisting material which can survive multiple conversions into a neck pillow. The front of convertible jacket 100 may comprise any standard jacket features such as zippers, pockets, buttons, etc. In some embodiments, convertible jacket 100 may be a pullover jacket.

Figure 2:
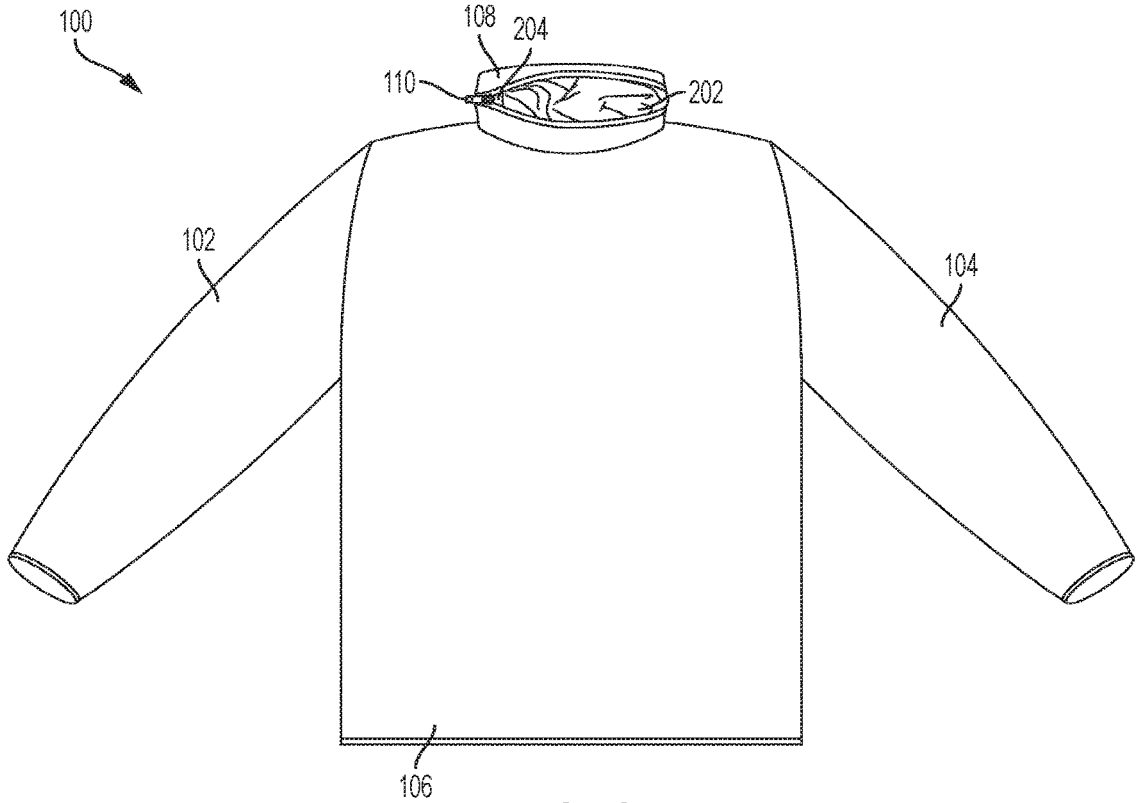
FIG. 2 is a rear view of the jacket showing the zipper on the collar undone to reveal the pouch.

Collar 108 comprises zipper 108 along a rear portion of collar 108 which can be zipped/unzipped using zipper 110 as depicted in FIG. 2 to reveal pouch 202 which resides inside a cavity 204 within collar 108. Cavity 204 may extend partway around collar 108 or may comprise the entire interior of collar 108 depending upon the size of the desired neck pillow. In some embodiments, zipper 110 does not extend an entire length of cavity 204.

Pouch 202 is preferably constructed from a soft, resilient material. A portion of pouch 202 may be formed from a soft material such as microfiber or may be formed from a stretchy (e.g., incorporating spandex) material to make stuffing easier.

Figure 3:
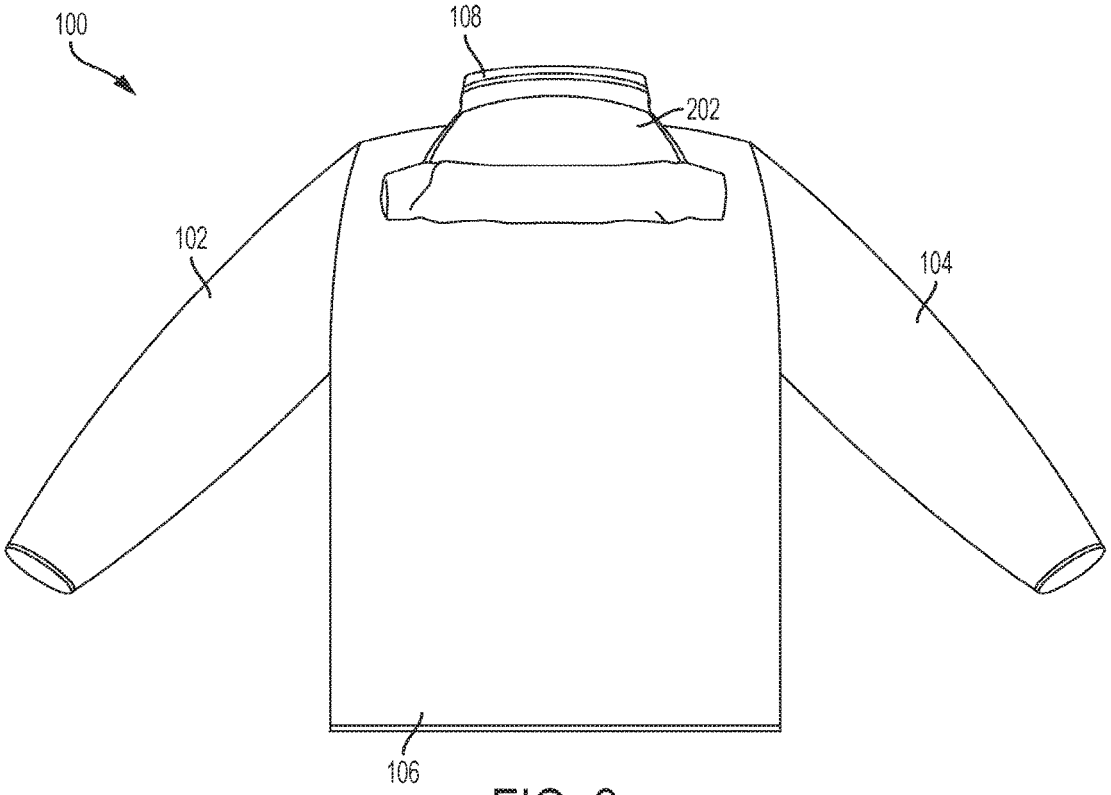
FIG. 3 is a rear view of the jacket showing the pouch partially unrolled.
Figure 4:
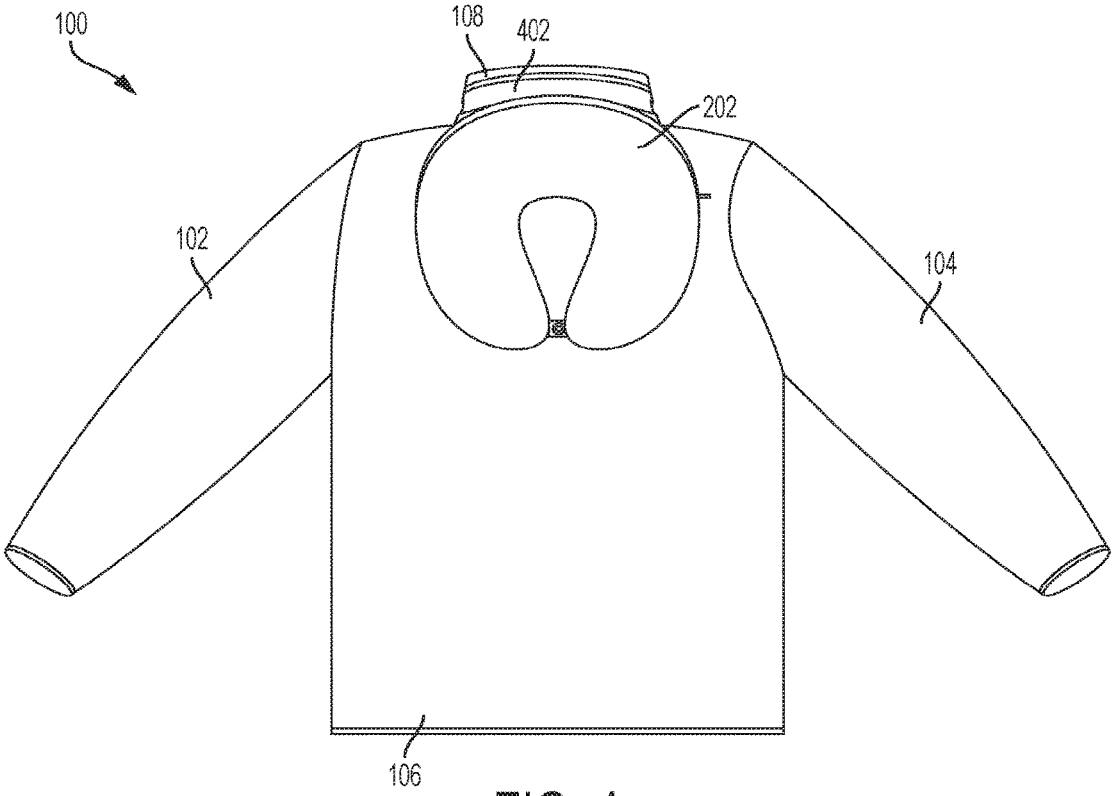
FIG. 4 is a rear view of the jacket showing the pouch fully unrolled.

To start conversion of convertible jacket 100, a user first unfolds pouch 202 as shown in FIG. 3 until the pouch is fully unfolded as shown in FIG. 4. A rear edge of pouch 202 is connected to cavity 204 by any suitable means such as sewing, adhesive, etc. via connection 402. This connection ensure that pouch 202 is not accidentally lost or misplaced when convertible jacket 100 is in jacket form. Pouch 202 is preferably in the shape of a neck pillow when unfolded as shown in FIG. 4. However, other shapes, such as a rectangular pillow, are also possible.

Figure 5:
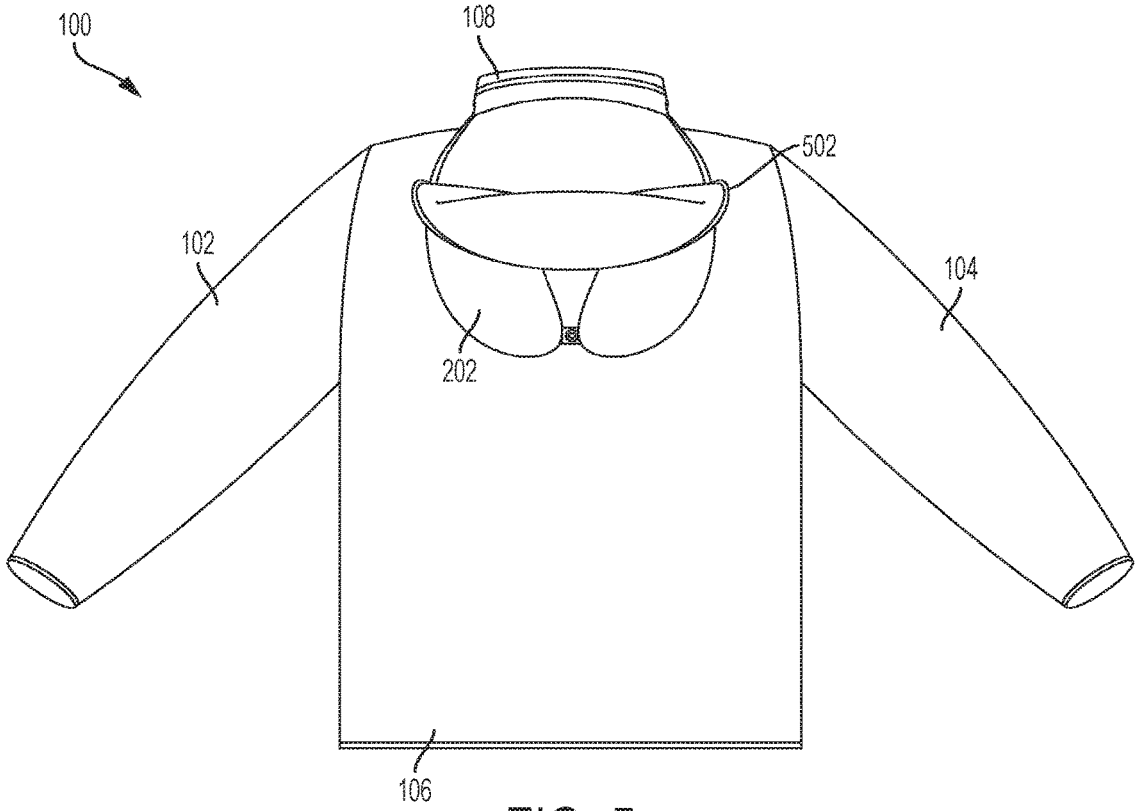
FIG. 5 is a rear view of the jacket showing the zipper of the pouch unzipped.
Figure 6:
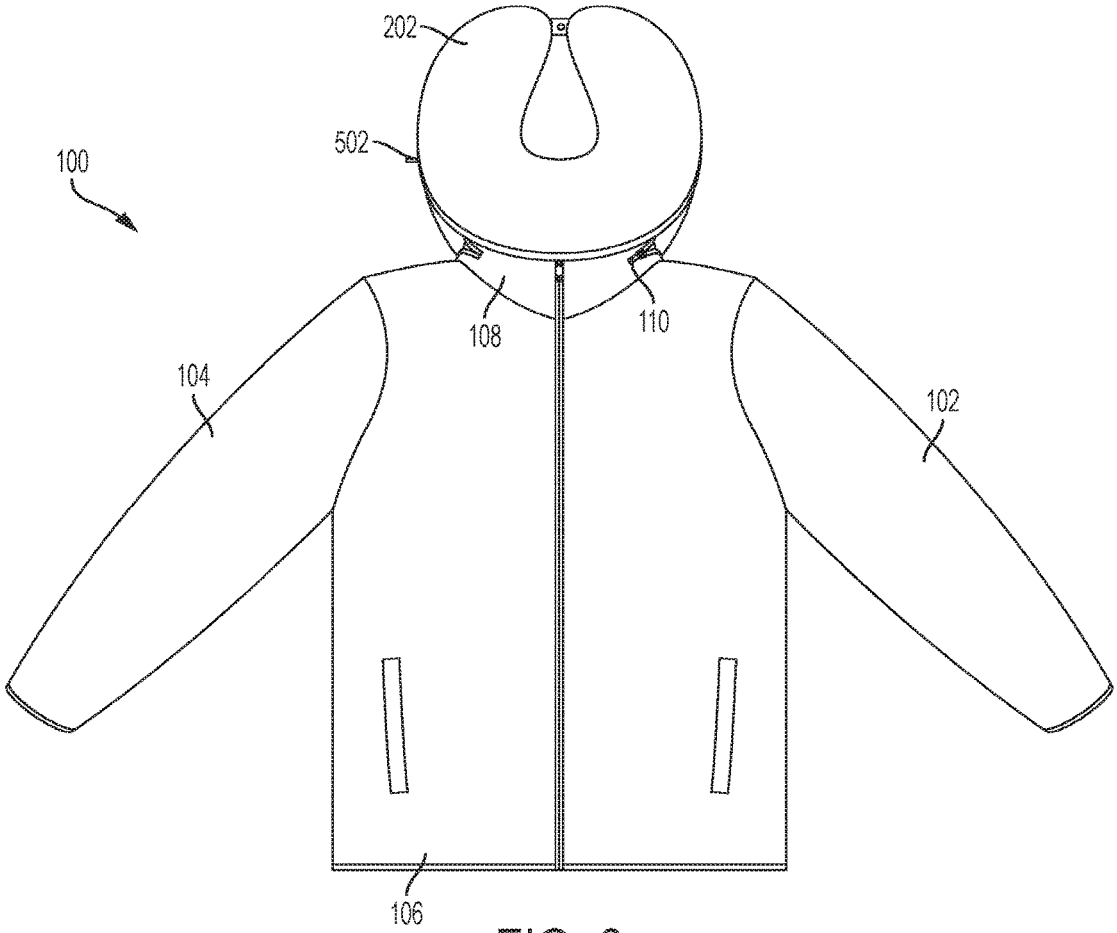
FIG. 6 is a front view of the jacket showing the jacket body and pouch positioned before insertion of the jacket body into the pouch.
Figure 7:
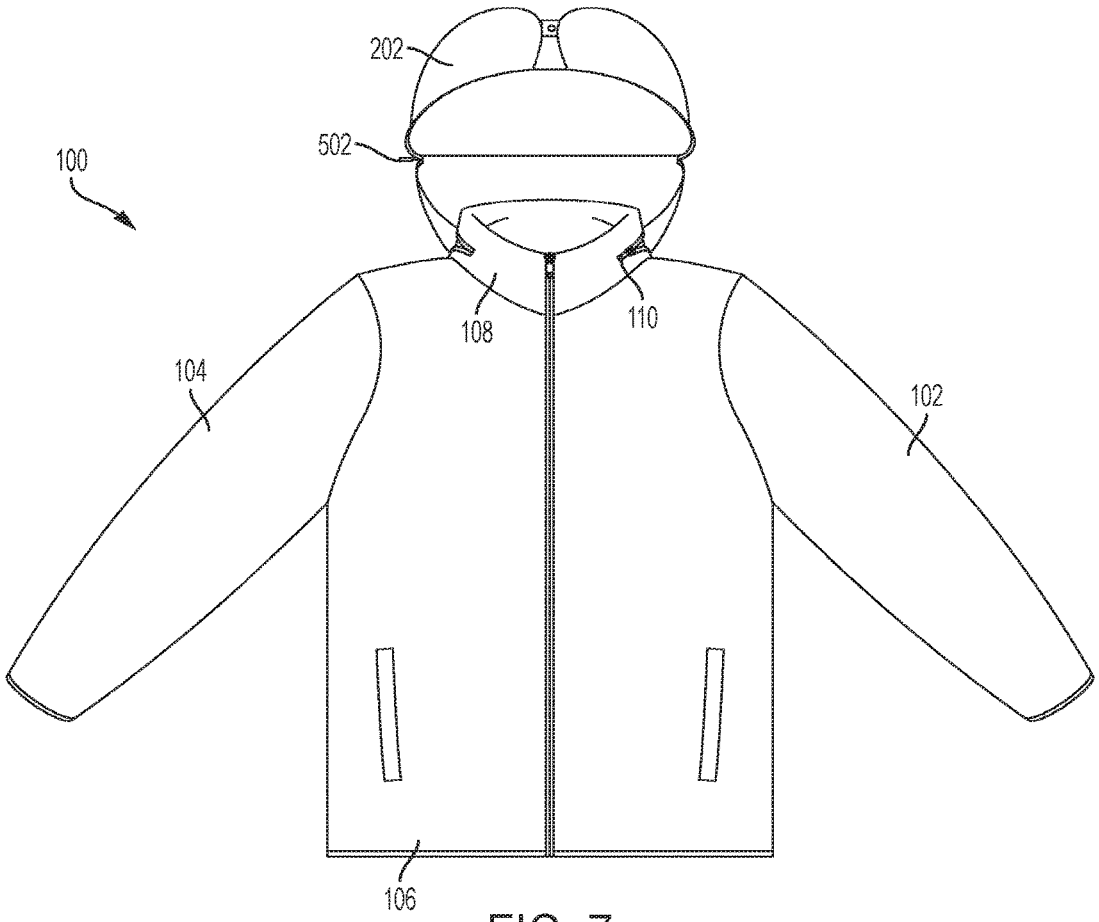
FIG. 7 is a front view of the jacket of FIG. 6 with the zipper on the pouch undone.

Referring now to FIG. 5, pouch 202 is shown opened using zipper 502 to reveal the interior of pouch 202 into which convertible jacket 100 is to be stuffed. However, pouch 202 is first lifted over collar 108 as depicted in FIG. 6 to make conversion of convertible jacket 100 simpler. In some embodiments, the direction of the pouch may be reversed so that stuffing of pouch 102 is accomplished from the rear instead of the front as depicted in FIG. 6.

Figure 8:
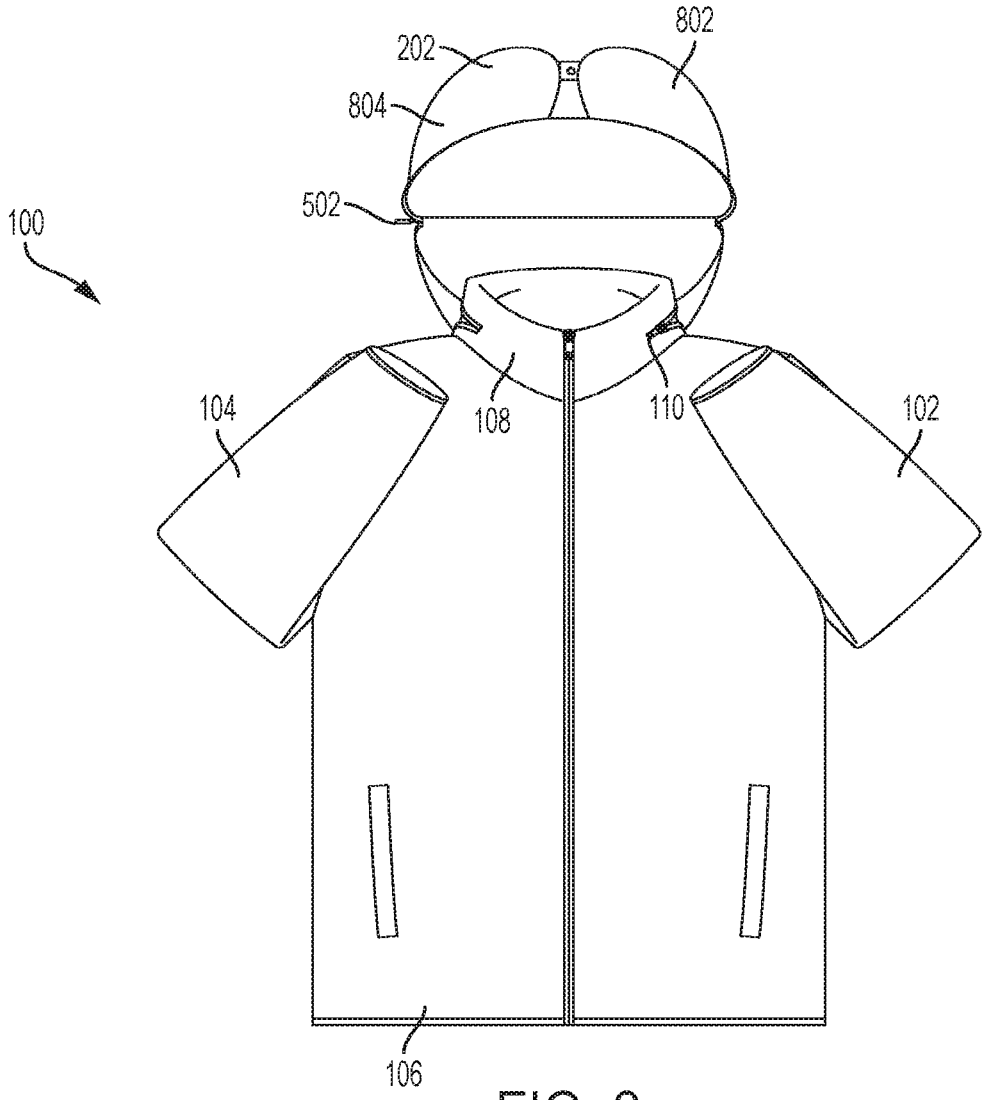
FIG. 8 is a front view of the jacket of FIG. 6 showing the arms of the jacket folded over the body of the jacket.
Figure 9:
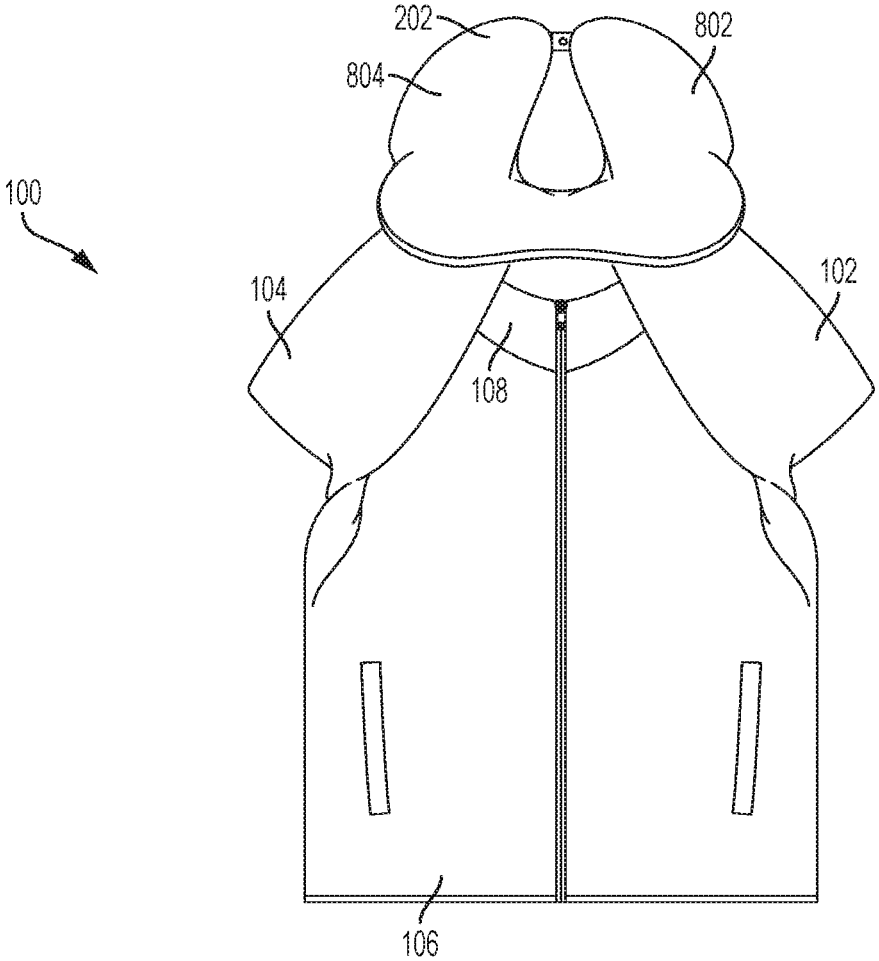
FIG. 9 is a front view of the jacket of FIG. 6 showing the arms of the jacket being inserted into pouch to form the arms of the neck pillow.
Figure 10:
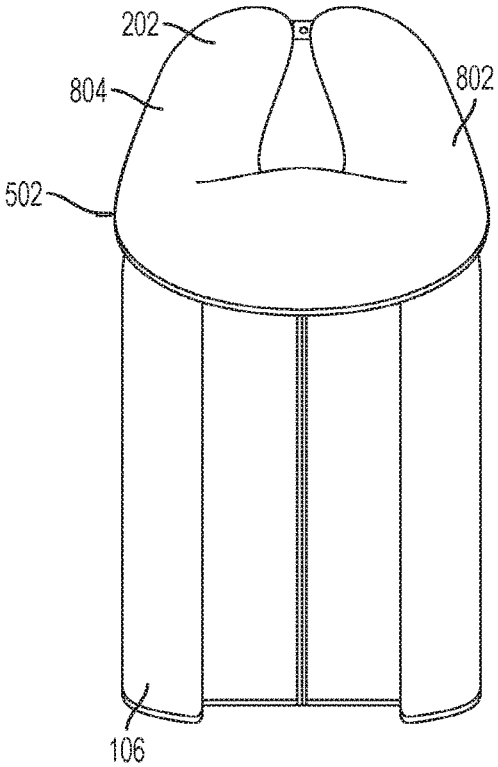
FIG. 10 is a front view of the jacket of FIG. 6 showing the arms of the jacket completely inserted into the pouch.
Figure 11:
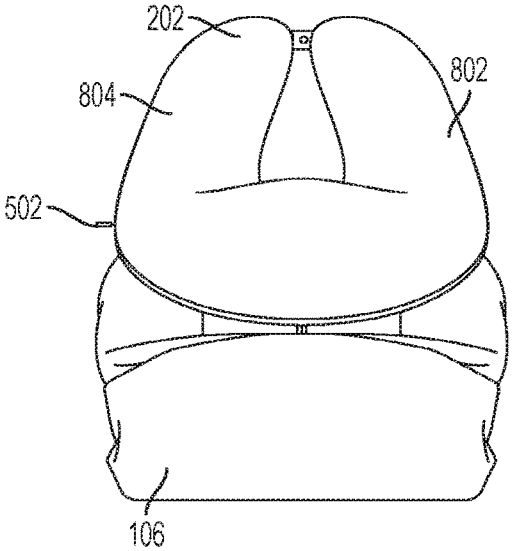
FIG. 11 is a front view of the jacket of FIG. 6 showing the body of the jacket folded toward the pouch.
Figure 12:
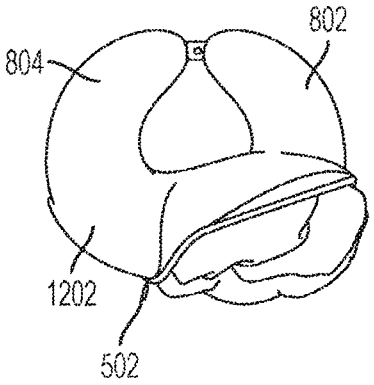
FIG. 12 is a front view of the jacket showing a portion of the body of the jacket being inserted into the pouch to form the body of the neck pillow.
Figure 13:
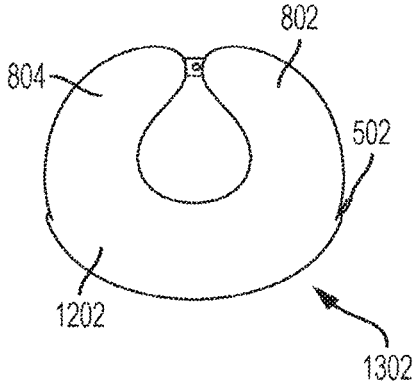
FIG. 13 is a view of the neck pillow after the zipper on the pouch has been closed to seal the arms and the body of the jacket inside the pouch.
Figure 14:
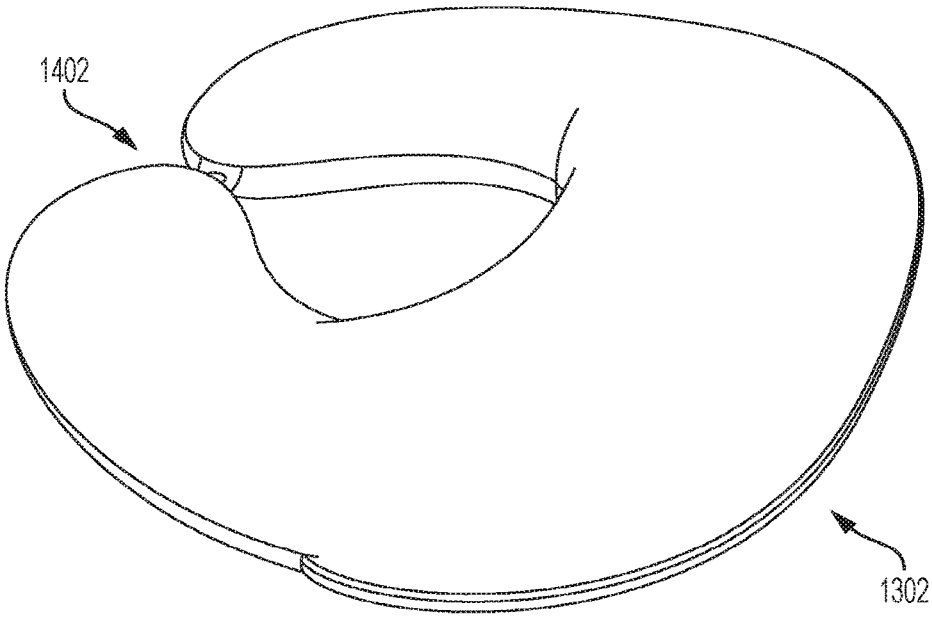
FIG. 14 is a rear perspective view of the neck pillow of FIG. 13.
Figure 15:
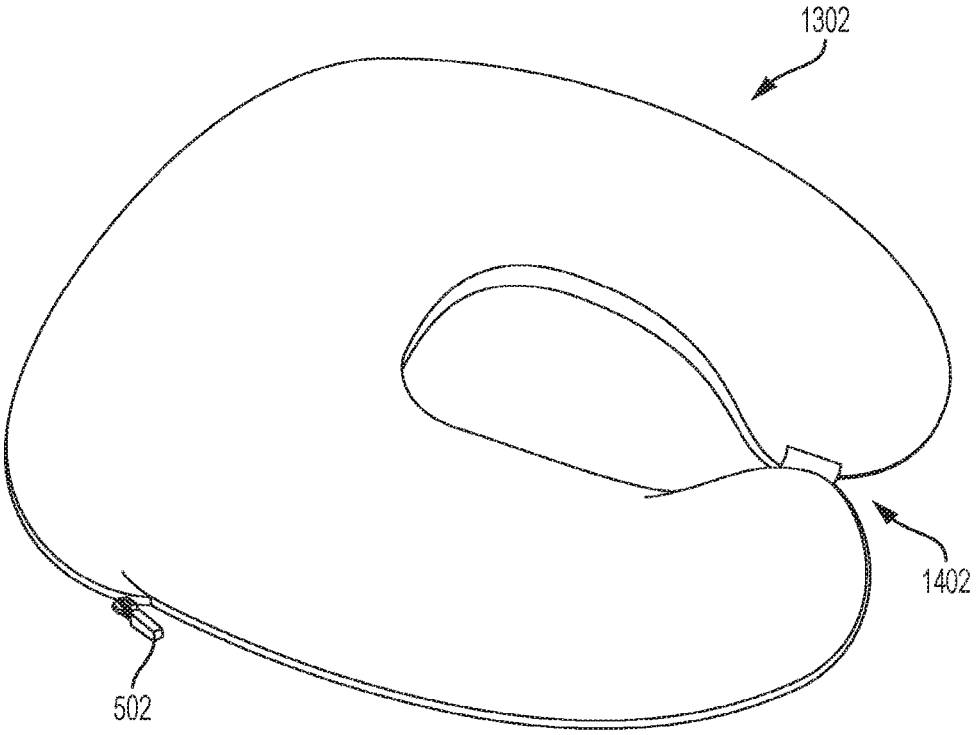
FIG. 15 is a front perspective view of the neck pillow of FIG. 13.

To form the arms of the neck pillow, a user first stuffs left arm 102 into left neck pillow arm 802 and right arm 104 into right neck pillow arm 804 as depicted in FIGS. 8-10. Next, to form the body of the neck pillow, a user folds or rolls the body 106 toward pouch 202 as shown in FIG. 11. Body 106 is then stuffed into neck pillow body 1202 as depicted in FIG. 12. Zipper 502 can then be zipped to seal left arm 102, right arm 104, and body 106 in pouch 202 to form neck pillow 1302 depicted in FIG. 13. The described process can then be reversed to turn neck pillow 1302 back into convertible jacket 100.

Neck pillow 1302 is able to achieve a more uniform appearance and consistent stuffing because each portion of convertible jacket 100 is placed into a corresponding portion of pouch 202 (i.e., left arm 102 is contained within left neck pillow arm 802). Such construction allows for a natural stuffing process and avoids having any one portion of neck pillow 1302 from having a higher stuffing/density than another portion of neck pillow 1302. In contrast, if a user simply stuffed a jacket into a pouch, the results would not be as consistently uniform or comfortable (e.g., left neck pillow arm 802 may end up with a significant portion of body 106, leaving neck the neck pillow). Having pouch 802 attached to collar 108 significantly avoids these pitfalls and imparts a more natural stuffing process to a user. Further, rolling body 106 toward collar 108 ensures that the zipper, or other jacket closure, will not be felt by a user of neck pillow 1302, this increasing user comfort.

Neck pillow 1302 preferably comprises closure 1402 which can be used to secure neck pillow 1302 around the neck of a user or to an object during travel. Closure 1302 may use any known closures such as snap fit closures, hook and loop closures, etc.

The invention claimed is:

1. A convertible jacket comprising:

a body;

a left arm connected to a first side of the body;

a right arm connected to a second side of the body;

a collar having a front face and a rear face;

a cavity located in the interior of the collar accessible through an opening in the rear face of the collar; and a pouch having an opening, wherein an exterior surface of the pouch is attached to a surface of the cavity.

2. The convertible jacket according to claim 1, wherein the opening comprises a zipper.

3. The convertible jacket according to claim 1, wherein the pouch comprises:

a central body;

a left arm attached to a left side of the central body;

a right arm attached to a right side of the central body, wherein the central body of the pouch, the left arm of the pouch, and the right arm of the pouch together form a shape of a neck pillow.

4. The convertible jacket according to claim 3, wherein an interior of the left arm is sized to accommodate the left arm of the convertible jacket through the opening of the pouch, an interior of the right arm is sized to accommodate the right arm of the convertible jacket through the opening of the pouch, and the central body of the pouch is sized to accommodate the body of the jacket through the opening of the pouch.

5. The convertible jacket according to claim 4, wherein the opening of the pouch comprises a zipper.

6. The convertible jacket according to claim 3, wherein the left arm of the pouch comprises a first mating structure, and the right arm of the pouch comprises a second mating structure for mating with the first mating structure.

7. A method for converting a jacket into a neck pillow, the method comprising:

removing a pouch through an opening in a rear of a collar of the jacket from a cavity in the collar, wherein a rear surface of the pouch pouch is attached to a surface of the cavity;

stuffing a left arm of the jacket into a left arm of the pouch through an opening in the pouch;

stuffing a right arm of the jacket into a right arm of the pouch through the opening in the pouch;

stuffing a body of the jacket into a central body of the pouch through the opening in the pouch; and sealing the opening in the pouch to form the neck pillow.

8. The method according to claim 7, wherein the body of the jacket is folded or rolled toward the pouch before being stuffed into the central body of the pouch.

* * * * *